US005897384A

United States Patent [19]

Hosler, Sr.

[11] Patent Number: 5,897,384

[45] Date of Patent: Apr. 27, 1999

[54] BOARD MOUNTABLE COAXIAL CONNECTOR

[75] Inventor: Robert Craig Hosler, Sr., Marysville, Pa.

[73] Assignee: The Whitaker Corporation, Wilmington, Del.

[21] Appl. No.: 08/957,556

[22] Filed: Oct. 24, 1997

[51] Int. Cl.[6] ..... H01R 9/09

[52] U.S. Cl. ..... 439/63; 439/581

[58] Field of Search ..... 439/63, 581, 79

[56] References Cited

U.S. PATENT DOCUMENTS

| | | | |
|---|---|---|---|
| 3,539,966 | 11/1970 | Logan | 439/63 |
| 4,647,136 | 3/1987 | Kinoshita et al. | 439/571 |
| 4,650,271 | 3/1987 | Forney, Jr. et al. | 439/578 |
| 4,687,267 | 8/1987 | Header et al. | 439/62 |
| 4,697,859 | 10/1987 | Fisher, Jr. | 439/246 |
| 4,717,218 | 1/1988 | Ratcliff | 439/59 |
| 5,035,641 | 7/1991 | Van-Santbrink et al. | 439/329 |
| 5,062,811 | 11/1991 | Hackman | 439/620 |
| 5,215,470 | 6/1993 | Henry et al. | 439/63 |
| 5,404,117 | 4/1995 | Walz | 439/63 |
| 5,405,267 | 4/1995 | Koegel et al. | 439/79 |
| 5,478,258 | 12/1995 | Wang | 439/581 |
| 5,532,659 | 7/1996 | Dodart | 439/63 |
| 5,702,271 | 12/1997 | Steinman | 439/676 |

FOREIGN PATENT DOCUMENTS

WO 96/17410 6/1996 WIPO ..... H01R 17/12

OTHER PUBLICATIONS

International Search Report mailed Apr. 8, 1998 in corresponding PCT/US97/20901 (two pages).

*AMP Customer Drawing No. C–415024*, "Connector, Right Angle, PCB, F Series", one sheet; Jun. 27, 1995; AMP Incorporated, Harrisburg, PA.

*Primary Examiner*—Neil Abrams
*Assistant Examiner*—T. C. Patel
*Attorney, Agent, or Firm*—Anton P. Ness

[57] ABSTRACT

Coaxial connector (10) for mounting to a circuit board (12) at an edge (14) thereof and having an outer conductor housing block (20) with an enlarged rearward housing section (22) and an elongate threaded cylindrical forward housing section (30). A bottom housing section (70) is provided that depends beneath downwardly facing housing surfaces (60) of wings (24) that are coplanar with inner conductor (40), extending through a board recess (16), with the bottom housing section (70) being provided rearwardly of forwardmost ends (62) of the downwardly facing housing surfaces (60). The bottom housing section (70) is sufficiently massive to move the center of mass of the connector rearwardly of the forwardmost ends of the downwardly facing surfaces (60) so that the connector (10) remains stablely positioned without tooling on the top of the circuit board during assembly prior to soldering thereto.

3 Claims, 2 Drawing Sheets

BOARD MOUNTABLE COAXIAL CONNECTOR

FIELD OF THE INVENTION

This relates to the field of electrical connectors and more particularly to coaxial connectors that are mountable to circuit boards.

BACKGROUND OF THE INVENTION

Coaxial connectors provide an inner or signal conductor coaxially disposed within an outer conductor both having precisely controlled radii having a common axis, with dielectric material disposed therebetween. Certain coaxial connectors are mountable to circuit boards, with the signal conductor electrically connected to a signal circuit of the board and the outer conductor electrically connected to a ground path on the board, and the electrical connections are commonly achieved by soldering. One such connector is disclosed in U.S. Pat. No. 4,650,271. In U.S. Pat. No. 5,405,267, a plurality of similar board-mountable coaxial connectors are secured to a mounting bracket that is affixed to a circuit board along an edge thereof, with each coaxial connector extending through a panel cutout at an input/output port of an electronic apparatus.

One such coaxial connector is commercially available from AMP Incorporated, sold as "F" Connectors under Part No. 415024-2. The outer conductor is a metal block housing that houses the inner conductor within a sleeve of dielectric material, and extends to a board-mount end and an opposing mating end defining an elongate threaded cylinder protruding substantially beyond the board edge that extends through a panel cutout and onto which a mating connector will be threadedly attached. The housing of such a connector would include downwardly facing surfaces of portions of the large rearward housing section to lie along that portion of the board surface adjacent the board edge prior to soldering, easily providing the outer conductor connecting sections solderable to ground circuits of the board. The inner conductor extends rectilinearly rearwardly, also aligned to lie along the board surface to be electrically connected to a signal path of the board. To optimize impedance matching in coaxial connectors, the enlarged rearward housing section is desired not only to surround the inner conductor but also to be substantially similar in cross-section to the cross-section of the mating coaxial connector; therefor, portions of the housing must extend below the surface of the circuit board onto which it is to be mounted, requiring a recess formed to extend into the board from the board edge sufficient to provide a clearance for the bottom half of the enlarged housing forwardly of the termination of the inner conductor to the signal path.

It is desired to provide a coaxial connector that is adapted to facilitate mounting to a circuit board utilizing automated assembly techniques including robotic pick-and-place equipment for accurately positioning the connector at a mounting site along a board edge, followed by soldering at a different work station to define the necessary electrical connections to the circuit board.

SUMMARY OF THE INVENTION

The present invention provides a coaxial connector to be mountable at a board edge by pick-and-place equipment, that rests stablely on the board surface at the mounting site prior to soldering without tooling, fixtures or retention sections using minimal board real estate.

The present invention provides a housing that includes an enlarged bottom housing half protruding through a board recess below the board-engaging housing surfaces inwardly from the board edge, sufficient in mass to locate the center of mass of the connector inwardly from the board edge, while maintaining a compact profile.

An embodiment of the present invention will now be described by way of example with reference to the accompanying drawings.

DETAILED DESCRIPTION OF THE INVENTION

Figure 4:
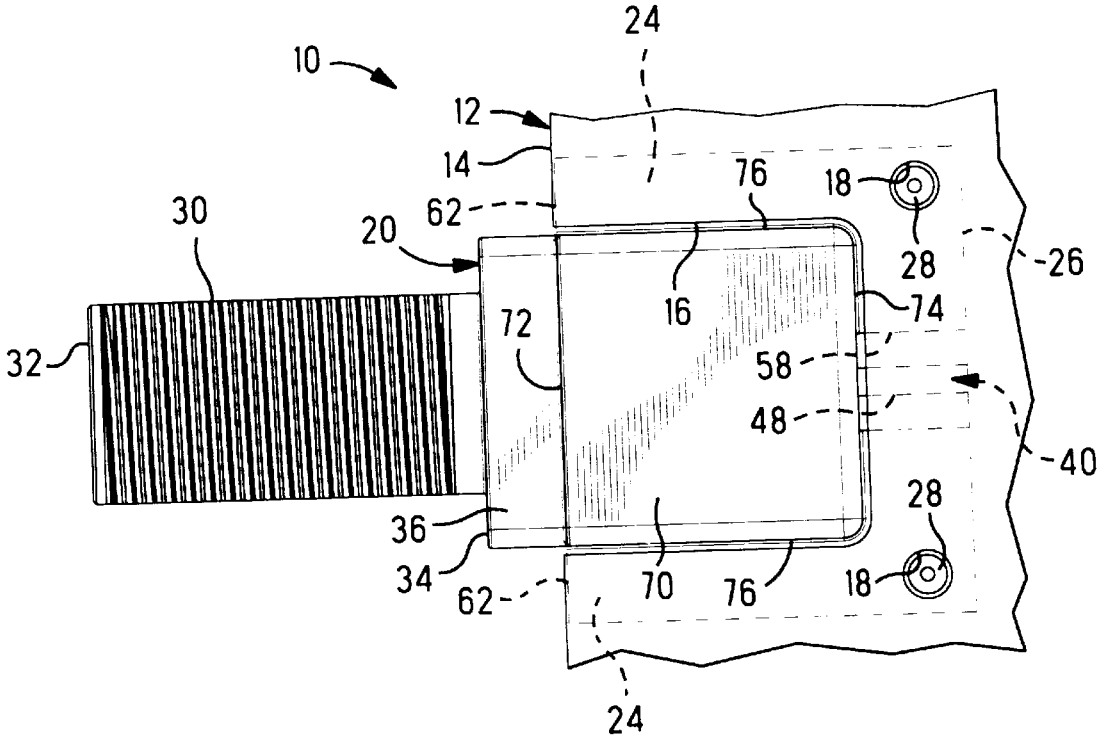
FIG. 4 is a bottom view of the connector mounted on a circuit board at a mounting site.

Coaxial connector 10 is mountable to circuit board 12 (FIG. 4) along an edge 14 thereof, with the board adapted for mounting at the mounting site by being provided with a recess 16 and locating holes 18. Outer conductor 20 of the connector is a metal block housing such as of nickel-plated die cast zinc, and includes an enlarged rearward housing section 22 having a pair of wings 24 along sides thereof extending forwardly from rear face 26, each of which includes a locating pin 28 depending therefrom receivable into a respective locating hole 18 of board 12 for accurately locating the connector upon being placed on the board at the mounting site.

Figure 3:
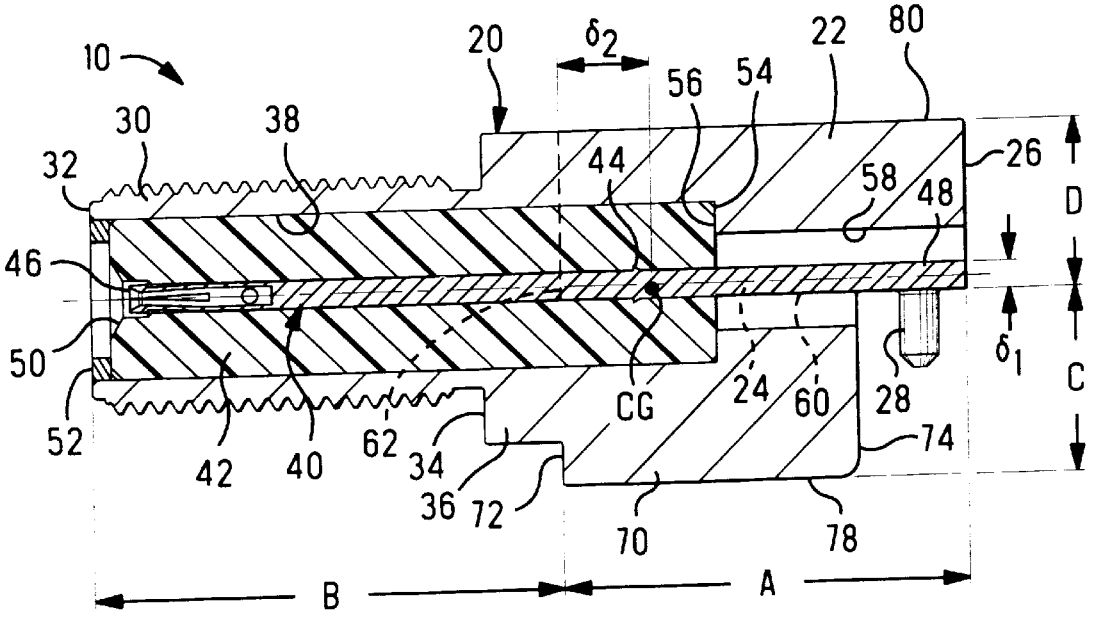
FIG. 3 is a longitudinal section view of the connector.

Forward housing section 30 is an elongated cylinder dimensioned in diameter less than the width and height of rearward housing 22, and extends to a leading end 32 that will protrude substantially beyond board edge 14 from forward face 34 of transverse flange 36 and through and beyond a panel cutout for mating with a complementary connector (not shown), with a threaded surface for a jam nut(not shown) and a mating connector's coupling nut (not shown) to be securely threaded thereonto to secure the connectors in their fully mated condition. Transverse flange 36 extends forwardly from the board edge for seating within a corresponding recess in the inside surface of a panel wall of the enclosure (not shown) into which the connector/circuit board assembly is to be placed for in-service use. As seen in FIG. 3, disposed coaxially within center bore 38 of outer conductor 20, is inner conductor 40 such as of beryllium copper disposed within a central passageway of a dielectric sleeve 42 such as of TEFLON polytetrafluoroethylene resin (trademark of E. I. DuPont de Nemours and Company, Wilmington, Del.).

Inner conductor 40 is conventionally held in sleeve 42 such as by small retention barbs 44, and comprises an elongate small diameter pin extending from a socket contact section 46 proximate leading end 32 of forward housing section 30 to a board-connecting section 48 extending to rear face 26 of rearward housing section 22. Dielectric sleeve 42 preferably defines an entrance 50 at leading end 32 tapered to form a lead-in just forwardly of socket contact section 46 to facilitate receipt of either an end of a coaxial cable conductor or a mating pin of the mating connector (not shown). Dielectric sleeve 42 is shown secured in center bore 38 by a metal retention ring 52 force fit into center bore 38 at leading end 32, with rearward sleeve end 54 abutting ledge 56 within the rearward housing section. Rearwardly of ledge 56 extends a smaller diameter rearward bore section extending to rear face 26, through which concentrically extends board-connecting section 48 of inner conductor 40 to rear housing face 26.

Preferably, board-connecting section 48 of inner conductor 40 will be disposed along the mounting surface of board 12 for soldering to a respective signal path of the board. Downwardly facing surfaces 60 of wings 24 also are disposed along the mounting surface of board 12 for soldering to ground paths of the board, and in FIG. 2 the bottom of board-connecting section 48 and the downwardly facing surfaces 60 are coplanar. It is preferred that wings 24 have a small thickness and be disposed in a plane with the inner conductor, serving simply to rest on the board surface adjacent recess 16 and to provide the locating pins, and then serve to electrically connect the outer conductor to board ground paths. Wings 24 extend from rear housing face 26 to forwardmost or leading ends 62 concluding just behind transverse flange 36.

In accordance with the present invention, the rearward housing section 22 is provided with a bottom portion 70 depending below coplanar downwardly facing surfaces 60 of wings 24 through board recess 16, that is adapted to provide sufficient mass in a compact shape effective to counterbalance the mass of the forward portion of the coaxial connector that not only protrudes outwardly beyond the board edge 14 but also which has almost half of its mass protruding below the plane of the top or mounting surface of the board. The present invention thus moves the center of mass inwardly from the board edge sufficiently to enable the coaxial connector to rest stablely on the board surface once simply placed in position, without holding tooling or discrete retention means of any kind prior to soldering (including being moved horizontally between work stations), where otherwise the coaxial connector would rotate forwardly and downwardly about the leading edge of the circuit board unless retained in position by fixtures, tooling or discrete retention means such as boardlocks or adhesive, or a rearwardly extending ballast. The present invention also minimizes the horizontal extent of any wings of the rearward housing section providing the downwardly facing surfaces abutting the circuit board, thereby minimizing the size of the mounting site and the rear estate of the circuit board occupied by coaxial connector 10.

Preferably, bottom portion 70 is block-shaped extending from a forward surface 72 to a rearward face 74 concluding forwardly of locating pins 28 and locating apertures 18, and having side surfaces 76 and a planar bottom surface 78, thereby having a shape and dimensions substantially complementary to those of a simply shaped and easily formed board recess 16, while depending through the recess and below the bottom surface of the circuit board. Forward surface 72 preferably is not positioned forwardly of a vertical plane intersection the forwardmost or leading ends 62 of wings 24. Also, preferably, the rearward housing section above board-connecting section 48 of inner conductor 40 extends fully to the rearwardmost extent of board-connecting section 48 of inner conductor 40 to assist locating the center of mass rearwardly of the forwardmost ends of the wings 24.

Also, in accordance with a further aspect of the present invention, a substantial planar region 80 is provided along the top surface of rearward housing section 22 rearwardly of a vertical plane intersection the forwardmost or leading ends 62 of wings 24, enabling gripping by vacuum pick-and-place equipment thereat that will move and position the coaxial connector in an automated assembly process.

Figure 1:
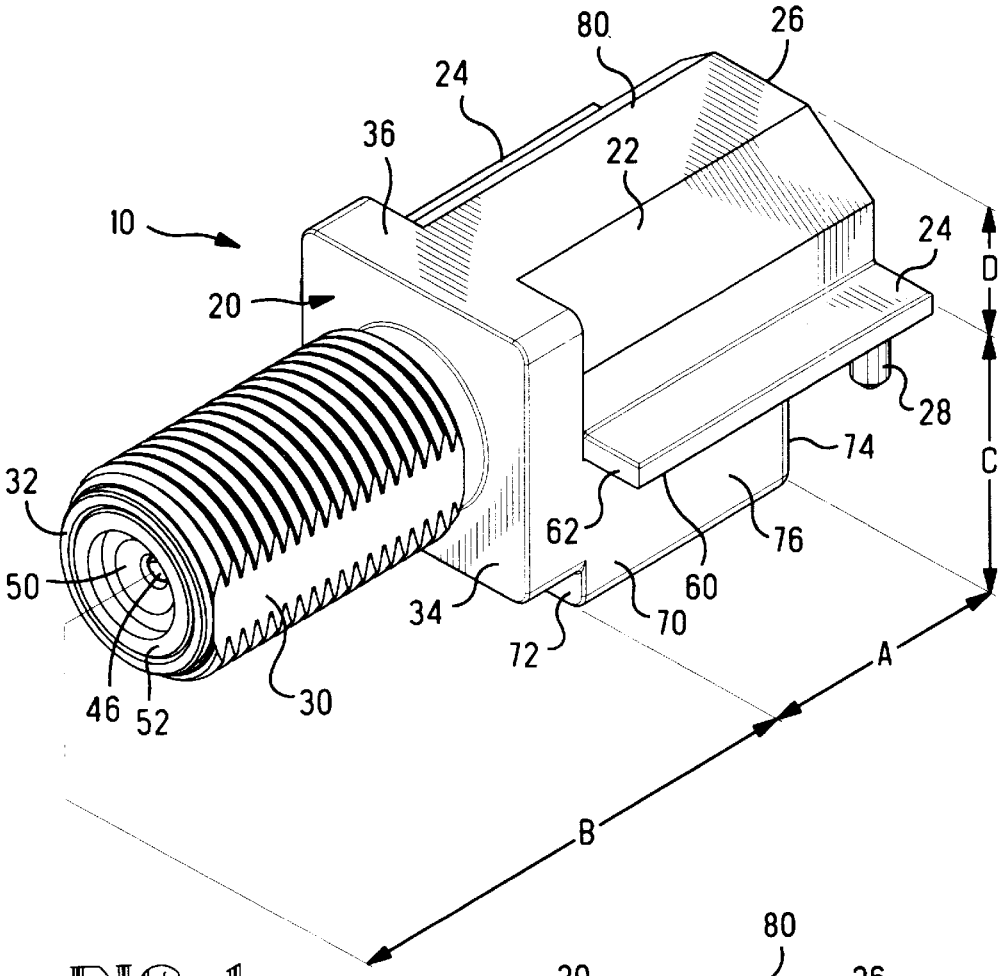
FIGS. 1 and 2 are isometric views of the coaxial connector of the present invention from forwardly and rearwardly thereof.

In FIGS. 1 and 3, it is seen that rearward region A of coaxial connector 10 is defined rearwardly from forward surface 72 of bottom housing portion 70 preferably aligned with leading ends 62 of wings 24, while forward region B includes forward housing section 30 as well as the transverse flange 36 that will be positioned outwardly of board edge 14 as seen in FIG. 3 for being disposed along an inner surface of the panel at an input/output port of the electronic equipment into which the circuit board will be installed, while the threaded forward portion extends through a panel cutout and receive a jam nut (with lock washer) threadedly thereon to secure the connector to the panel along the outer panel surface (also using a grommet along the inside panel surface), and then threaded thereonto a coupling nut of the mating connector.

Figure 2:
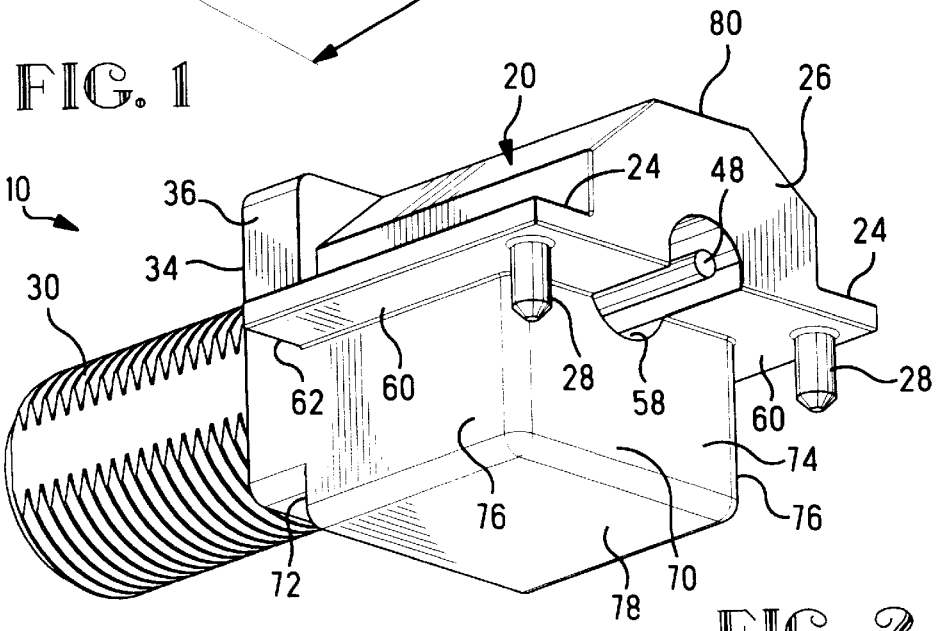

Also, as seen in FIGS. 1 to 3, lower region C is defined below the level of downwardly facing surfaces 60 of wings 24 and below inner conductor 40, while upper region D is the region above the mounting plane.

In one example of connector 10: sleeve 42 is TEFLON and the center contact diameter is 0.045 in.; forward housing section 30 is 0.625 in. long with an outer diameter of 0.315 in.; center bore 38 1.00 in. from leading end 32 to ledge 56 with a diameter of 0.260 in., and rear bore 58 is 0.157 in. in diameter; transverse flange 36 is 0.125 in. front to back and 0.500×0.500 in. in height and width; rearward housing section 22 in upper region D is 0.655 in. front to back with a widest width of 0.500 in., and 0.198 in. across top surface 80 and a height of 0.269 in. Bottom housing portion 70 in lower region C and rearward region A is 0.470 in. front to back, 0.500 in. wide and 0.298 in. deep depending beneath downwardly facing surfaces 60 of wings 24. It has been calculated that the center of gravity CG (FIG. 3) lies a distance $\Lambda_1$ 0.0245 in. below the center axis of the contact and in a vertical plane located a distance $\Lambda_2$ 0.110 in. rearwardly of forwardmost surfaces 62 of wings 24 and front surface 72 of bottom housing portion 70, sufficiently rearwardly of forwardmost surfaces 62 of wings 24 substantially coincident with the edge of the circuit board for connector 10 to remain stablely positioned on board 12 without assistance, prior to and during soldering.

In a second example, the location of the center of gravity was calculated for a connector of similar size and shape, except that the sleeve was formed of 30% glass-filled polyester, which is heavier than TEFLON; and the bottom housing portion was less deep (0.231 in. below the downwardly facing surfaces), with the bottom surface coinciding with the bottom of the transverse flange. The center of gravity was located in a vertical plane 0.080 in. rearwardly from the forwardmost edges of the wings and approximately along the center axis of the contact.

The coaxial connector of the present invention is impedance matched to provide a higher performance 75 ohm connector for transition from a standard 75 ohm coaxial cable such as is preferred for transmission of telephone and video signals received into a Network Interface Box or Cable Access Unit, at an office or residence from a distribution cable. The connector described herein is adapted for the ground circuits extend in a planar direction continuously from the connector to the circuit board, the ground circuits spaced apart from the signal circuit on either side an optimum distance on both the connector and the board circuit pads, meeting the requirements of a coplanar waveguide arrangement having the advantage of minimal signal degradation requiring minimal tuning of the circuit board after assembly.

Variations and modifications may be made to the specific connector disclosure herein, that are within the spirit of the invention and the scope of the claims.

What is claimed is:

1. A coaxial connector adapted for mounting to a circuit board and having an outer conductor housing block and an inner conductor coaxially disposed within a bore therethrough held within a dielectric sleeve and having an exposed rear board-connecting section aligned with a mounting surface of the circuit board for electrical connection to a signal circuit thereof to a forward contact section extending to a leading end of an elongate cylindrical forward housing section, where an enlarged rearward housing section includes coplanar downwardly facing surfaces aligned and adjacent to the mounting surface of the circuit board at a mounting site thereof for electrical connection to ground circuits of the board, the improvement comprising:

a bottom housing portion rearwardly of forwardmost ends of said downwardly facing housing surfaces and depending below said downwardly facing housing surfaces with a horizontal cross-section complementary to and dimensioned to be smaller than a recess cut into the circuit board along an edge thereof at the mounting site, said bottom housing portion being sufficiently massive to counterbalance a mass of forward portions of the connector protruding forwardly of forwardmost ends of said downwardly facing housing surfaces, whereby a center of mass of the connector is located rearwardly of said forwardmost ends of the downwardly facing housing surfaces and the connector remains stablely positioned on the mounting surface of the circuit board once positioned there prior to soldering without any position-retaining means.

2. The coaxial connector as set forth in claim 1 wherein a top surface of said rearward housing section is planar to define a gripping surface rearwardly of said forwardmost ends of said downwardly facing housing surfaces, facilitating use of vacuum pick-and-place equipment during mounting of the connector to the circuit board.

3. The coaxial connector as set forth in claim 1 wherein the rearward housing section extends to the rearwardmost extent of said board-connecting section of said inner conductor.

* * * * *